US005537757A

United States Patent [19]

Gray

[11] Patent Number: 5,537,757

[45] Date of Patent: Jul. 23, 1996

[54] BELT DRYER

[75] Inventor: Dale D. Gray, Lubbock, Tex.

[73] Assignee: Kimbell Gin Machinery Company, Lubbock, Tex.

[21] Appl. No.: 395,578

[22] Filed: Feb. 27, 1995

[51] Int. Cl.[6] ..... F26B 9/00

[52] U.S. Cl. ..... 34/164; 34/208; 34/216; 34/401

[58] Field of Search ..... 34/164, 401, 203, 34/207, 208, 216

[56] References Cited

U.S. PATENT DOCUMENTS

| | | | |
|---|---|---|---|
| 1,011,444 | 12/1911 | Kihlgren . | |
| 2,743,004 | 4/1956 | Wright . | |
| 3,272,155 | 9/1966 | Royer | 34/208 |
| 3,456,357 | 7/1969 | Griffith | 34/401 |
| 4,305,210 | 12/1981 | Christensen et al. | 34/164 |
| 4,333,246 | 6/1982 | Sullivan et al. | 34/401 |
| 4,823,479 | 4/1989 | Dornier et al. . | |
| 5,038,498 | 8/1991 | Woolsey | 34/208 |
| 5,105,557 | 4/1992 | Vadasz | 34/401 |
| 5,392,529 | 2/1995 | Bailey et al. | 34/164 |

OTHER PUBLICATIONS

"The Belt Dryer", J. W. Laird and R. U. Baker, Jan. 94, pp. 640–643.

"Quality Aspects Of Belt Conveyor Dryer Use on Seed Cotton", Weldon Laird, Milton Smith, Gary Barker, Jan. 94, pp. 1724–1726.

"Belt Type Conveyor Dryer Operation in Cotton Gins", Laird Baker, Smith, Stewart, Jun. 92, pp. 1–21.

*Primary Examiner*—John T. Kwon

*Attorney, Agent, or Firm*—Wendell Coffee

[57] ABSTRACT

Seed cotton on a wire mesh belt is dryed and cleaned by a downflow of heated air. The natural separation and falling of trash from the belt is increased by shaking the mass of seed cotton upon the wire mesh belt. The belt is flexed to shake the seed cotton upon it. The belt is flexed by running the belt over "V" shaped intermittent supports. The belt is also shaken by being bumped by gussets on rollers beneath the belt. The air is exhausted from beneath the belt by ducts extending across the chamber. The tops of the ducts are inclined planes so that the trash slides from the top of the duct and does not accumulate on the top.

20 Claims, 2 Drawing Sheets

BELT DRYER

CROSS REFERENCE TO RELATED APPLICATION

None, however, Applicant filed Disclosure Document Number 362,062 on Sep. 22, 1994 which document concerns this application; 1706)

BACKGROUND OF THE INVENTION

1. Field of the Invention

This invention relates to conditioning and cleaning fibrous material and more particularly seed cotton. This invention particularly utilizes a air permeable belt to support the fibrous material while it is being dried and cleaned. Cotton ginners have ordinary skill in this art.

2. Description of the Related Art

As early as 1985 laboratory studies were made by J. W. Laird and R. V. Baker which indicated that wire mesh belt conveyor could be used in a cotton drying system.

The first full scale belt dryer was constructed and tested in Arizona in 1991, these belt dryers used a wire mesh belt dryer and had a continuous support beneath the belt. The continuous support included a single diagonal support beneath the belt, also the belt was extended through a chamber with downdraft drying, that is to say heated dry air was introduced above the cotton and the treated air passed through the cotton to outlets below the cotton. In this case, the supports included a diagonal support extending from one side of the chamber to the other. The edge of the wire belt was supported by a support flange running along the sides of the chamber and was held down by a hold down flange extending above the support flange along the sides of the chamber. The exhaust ducts under the belt had a circular cross section with the inlets into the duct at the bottom. The bottom run of the wire mesh belt was supported by the bottom of the chamber and a cross conveyor was located near the inlet end of the chamber to remove trash which was moved to that end by the bottom belt dragging along the bottom of the chamber. A second installation was installed in Texas in 1992. The Texas installation did not include any additional features pertinent to this application.

SUMMARY OF THE INVENTION

1. Progressive Contribution to the Art

This application discloses certain improvements over the previous two experimental installations. Particularly, improvements have been made to cause more trash to be separated from the fibrous material being handled. This is accomplished by intentionally flexing the one-half by one-half modified wire mesh belt. The flexing of the belt will result in shaking the material upon the belt, therefore permitting the release of additional trash.

The belt is flexed sufficiently to cause certain movement of the mass upon the belt without agitating the mass. The normal drying action of the heated air is to be that the heated air flows through the mass of material and not around clumps of the fibrous material. For example: if the flexing of the belt is so vigorous that seed cotton is separated into individual locks, the air tends to flow around the locks. The seed cotton is dried better if the mass of material remains intact with the air flowing through the locks.

The main preferred method of flexing or undulating is by having the belt carrying the mass of seed cotton upon it over intermittent "V" shaped supports. This permits sufficient flexing or undulating to release trash from seed cotton without forming undesirable air passage ways through the mass.

Also, the belt is secondarily flexed by bumper rollers beneath the mass flexing the belt upward at points where otherwise the belt is sagging downward between the intermittent supports. The bumping of the belt is also restricted to cause the flexing to be within the above parameters.

To prevent the trash from building up on top of exhaust air ducts below the belt, the tops of the exhaust ducts are formed by inclined planes which slope sufficiently to permit the trash to slide from the tops rather than accumulate on the tops.

2. Objects of this Invention

An object of this invention is to condition and clean fibrous material.

Another object of this invention is to dry and clean seed cotton in a belt dryer chamber.

Further objects are to achieve the above with devices that are sturdy, compact, durable, lightweight, simple, safe, efficient, versatile, ecologically compatible, energy conserving, and reliable, yet inexpensive and easy to manufacture, install, operate, and maintain.

Other objects are to achieve the above with a method that is rapid, versatile, ecologically compatible, energy conserving, efficient, and inexpensive, and does not require highly skilled people to install, operate, and maintain.

The specific nature of the invention, as well as other objects, uses, and advantages thereof, will clearly appear from the following description and from the accompanying drawings, the different views of which are not necessarily scale drawings.

Figure 1:
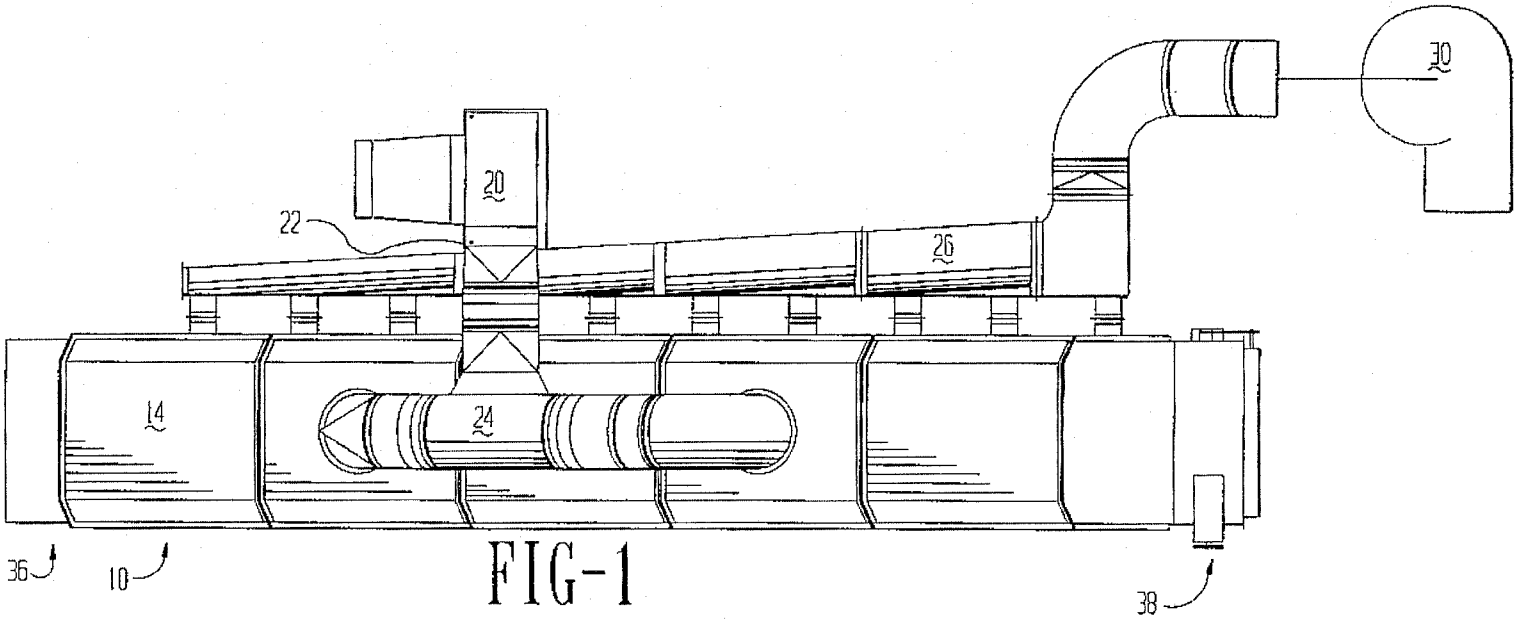
FIG. 1 is a top plan view of an embodiment of the invention.
Figure 2:
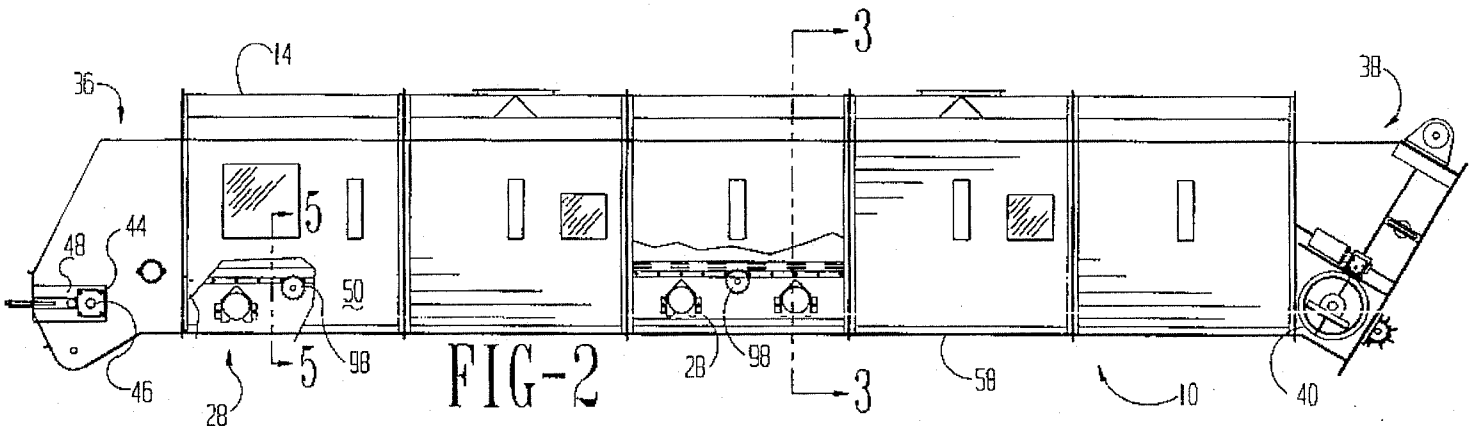
FIG. 2 is a sectional view of the drying chamber taken substantially on line 2—2 of FIG. 1.

The sag of belt in the drawings has been exaggerated for the purpose of illustration.

DESCRIPTION OF THE PREFERRED EMBODIMENTS

The structure for the belt dryer includes an elongated drying chamber 10. The drying chamber includes a treated air plenum 12 extending along the entire top 14 of the chamber. The bottom of the plenum 12 is formed by a perforated ceiling 16 to evenly distribute the treated air from the plenum into the main chamber 18.

The air to be fed through the plenum is treated. Normally, the air will be treated by heating as shown in the drawings schematically by heater 20. Thus, the fibrous material will be dryed by the heated, dryed air. The heated air will be conveyed to the plenum by duct 22 which is bifurcated at Y 24. It is desirable to have the air dispersed evenly through the perforations into the main chamber 18.

It will be understood that the air to be delivered could contain excessive moisture in the event it was desired to add moisture to extremely dry fibrous material. Also, situations where other types of air treatment might be provided. The spent air is withdrawn through spent air header 26. The spent air header is connected to exhaust ducts 28 which extend into the chamber as specified later. The spent air header is pneumatically connected to the inlet of exhaust fan 30. It has been found that better treatment of the fibrous material is obtained if the treated air is drawn from above the mass of treated material 32 through the treated material and the air permeable belt 34 which supports the mass of treated material.

The elongated drying chamber has an inlet end 36 for loading the fibrous material into the chamber. Also, the chamber 10 has an outlet end 38 where the fibrous material is removed from the chamber. The air permeable belt 34 in the form of a half by half modified wire mesh belt is trained over two wheels. Drive wheel 40 extends across the chamber at the outlet end 38. The wheel 40 is powered by suitable motor, not shown, for clarity and conciseness of the drawings. Adjustable wheel 42 extends across the chamber at the inlet end 36. The wheel 42 is adjustable inasmuch as bearings 44 which support shaft 46 of the adjustable wheel 42 are mounted on plates 48 which may be longitudinally moved along the sides 50 of the elongated chamber 10. Those skilled in the art will understand that to keep proper tension in the belt it is necessary to have an adjustment. The drive wheel 40 and adjustable wheel 42 are in the form of sprockets 52 which engage the wire mesh belt 34.

The belt has top run 54 upon which the mass of treated material 32 is placed. Bottom run 56 of the belt is supported by bottom or floor 58 of the chamber 10. The exhaust ducts extend from one chamber wall or side 50 to another below the top run 54 and above the bottom run 56 respectively. The side along the spent air header 26 has a circular opening at each exhaust duct whereby the spent air may be conveyed from the exhaust duct to the spent air header to be drawn to the fan 30.

The exhaust ducts 28 in cross section are pentagons. Each of the ducts 28 has two sides 60, a slotted bottom 62 and an inclined roof or top 64. The top is preferably formed by two inclined planes. The inclined planes slope from the center downward to each side. The pitch of the slopes or inclined planes are sufficiently steep so that any trash falling upon the top of the exhaust ducts 28 will slide from the exhaust ducts downward. It is important not to permit trash from accumulating on the tops of the exhaust ducts inasmuch as when a sufficient mass of accumulated trash accumulates and falls off it interrupts the operation of the dryer. It appears that a one to one pitch, which is to say that an inclination of 45 degrees is sufficient for the inclined planes to satisfactorily to shed trash which would fall upon them.

Trash which falls downward will mainly fall through the bottom run 56 of the belt 34 and be conveyed to the inlet end 36 of the chamber 10. Trash conveyor 66 extends across the inlet end of the chamber. It is located below the main floor 58 of the chamber as shown in the drawing. An auger conveyor works well to remove the trash which is conveyed by the bottom run of the belt to the inlet end.

To eliminate as much trash as possible which might remain on the top of the bottom run 56, scraper 68 is mounted near the inlet end 36. The scraper is mounted between the top and bottom run at a location which is free of the adjustable wheel 42 when the adjustable wheel is at its extreme inward position. The scraper includes a flexible flap 70 preferably of reinforced rubber which is attached to a clamp 72. The flap 70 may be extended for adjustment purposes or for wear. Conveyor 74 extends across the chamber above the bottom run 56 of the belt 34 and also partially above the flap 70 as shown in the drawings. Therefore, this will prevent trash from being carried around the adjustable wheel 42. The clamp 72 is attached to a trash scroll 76 which is mounted for vertical movement so that the entire clamp assembly can be raised or lowered.

Plate 78 extends across the chamber above the conveyor 74 and is attached to the two sides 50 of the chamber 10. The plate 78 prevents trash from falling at the inlet end 36 onto the adjustable wheel 42. It will be understood that as the fibrous material is loaded into the dryer that considerable trash will sift through the belt 34 at that point. The plate 78 prevents this trash from fouling the adjustable wheel 42.

Preferably, the chamber 10 is built in modules of five foot length. If the elongated chamber is basically 25 feet in length there would be five modules bolted together. Each module has at its top perforated ceiling 16 which would be the bottom of the treated air plenum 12 and a main chamber 18 extending from the treated air chamber to the top run 54 of the belt 34. Also, each of the sides 50 has flange 80 in the form of an angle iron which supports edge 82 of the belt 34. Above the belt, another flange called hold down flange 84 will be a portion of an angle iron which will prevent the edge of the belt from rising.

The belt 34 is supported primarily by intermittent "V" shaped supports 86. The "V" shaped supports include two legs 88, one extending from the angle iron of flange 80 to center strap 90. Each of the legs is conveniently welded to the angles and to the strap. Each of the legs 88 is in the form of angle irons. The point of the "V"s point toward the outlet end 38 of the chamber 10. The "V" shaped supports are placed about 20 inches on center in the five foot modules, that is to say, there will be three "V" shaped supports for each module. Straight cross piece 92 will extend directly across the chamber at each end of each module. If the chamber is about four feet in width, the legs will form about a 60 degree angle with the sides 50 of the chamber 10.

Figure 6:
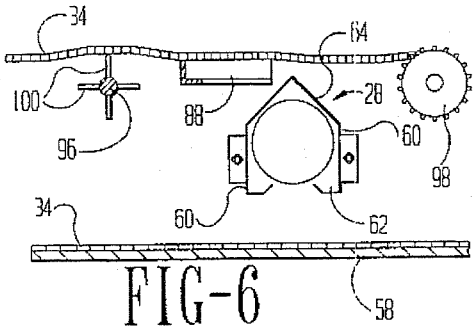
FIG. 6 is a sectional detail taken substantially on line 6—6 of FIG. 5 of a portion of FIG. 2 showing a cross section of an idler roller and exhaust duct and showing the belt sag between adjacent "V" shaped supports.
Figure 7:
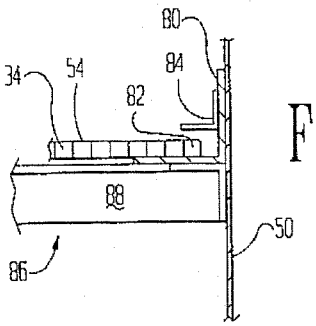
FIG. 7 is a detail of a portion of FIG. 3 showing a flange and a holddown flange.
Figure 8:
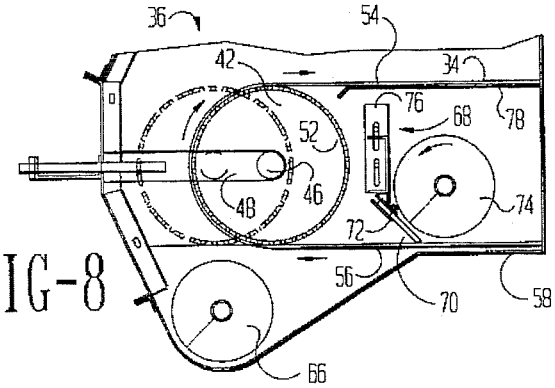
FIG. 8 is a detail of FIG. 2 showing the flexible flap.

It is desirable that there be a space between "V" shaped supports 86 where the top run 54 of the belt 34 is supported only by the flanges 80 on each side and the center strap 90 in the middle. This permits the belt to sag or flex between "V" shaped supports as seen in FIG. 6. Also, as the belt runs on the "V" shaped supports, the belt will be trained toward the center and not trained to one side or the other.

Figure 5:
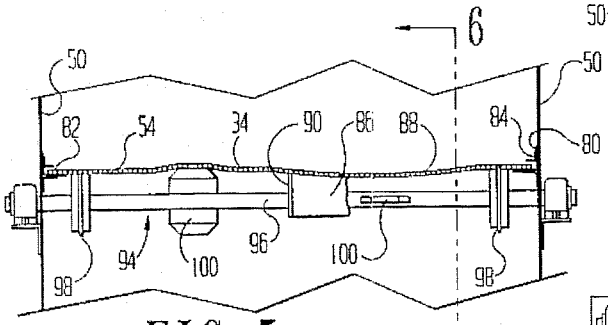
FIG. 5 is a detail of an idler roller taken substantially on line 5—5 of FIG. 2.
Figure 4:
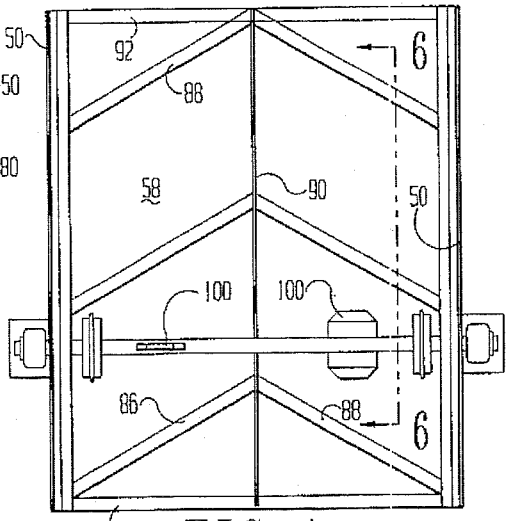
FIG. 4 is a plan view of the "V" shaped supports taken substantially on line 4—4 of FIGS. 2 and 3.
Figure 3:
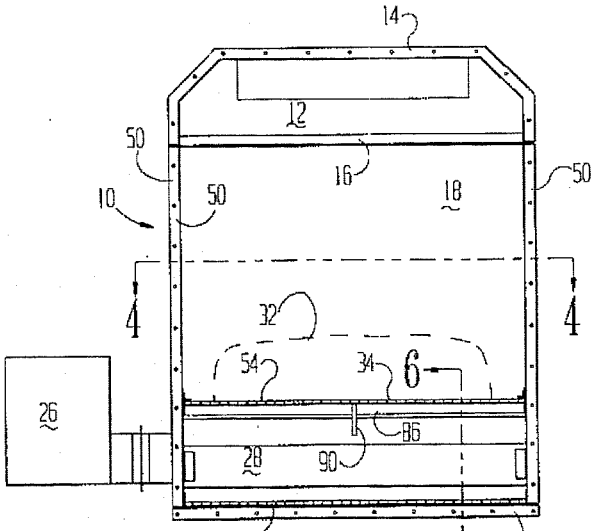
FIG. 3 is a sectional view of the drying chamber taken substantially on line 3—3 of FIG. 1.

At least one idler roller 94 is journalled by bearings mounted on the sides 50 of each module. Shaft 96 of the idler rollers is located immediately below the center strap 90. Each roller is mounted between two "V" shaped supports as seen in the drawings. A sprocket 98 is attached to the shaft near the bearings on each side and engages the top run 54 of the belt 34 and is therefore driven by it. Each of the shafts 96 has a diagonal wing or gusset 100 attached thereto. The gusset extends when in the vertical position above the top of the "V" shaped supports.(See FIG. 5) Two diagonal gussets are mounted on each shaft, one operating between the angle iron of the flange 80 on one side and the strap 90 at the center and one between the opposite flange and the center strap. As the idler roller is rotated, the gussets 100 or wings bump the belt causing it to flex upward.

It will be understood that the belt 34 will be flexed by the bumping of the belt from below and also be flexed as it is run over intermittent "V" shaped supports 86. The flexing of the belt will shake the fibrous material, aiding in the release of trash from the fibrous material, thereby aiding the cleaning of the material. The shaking will also prevent excessive packing of the fibrous material from the downflow of the treated air downward through the mass of the fibrous material.

It is desirable not to agitate or to break up the mass of fibrous material inasmuch as this tends to cause the air to flow between locks or clumps of material rather than flow through the fibrous material itself.

The embodiment shown and described above is only exemplary. I do not claim to have invented all the parts, elements or steps described. Various modifications can be made in the construction, material, arrangement, and operation, and still be within the scope of my invention.

The restrictive description and drawings of the specific examples above do not point out what an infringement of this patent would be, but are to enable one skilled in the art to make and use the invention. The limits of the invention and the bounds of the patent protection are measured by and defined in the following claims.

I claim as my invention:

1. The process of conditioning fibrous material by a) loading the fibrous material on a moving, air permeable belt, and b) drawing treated air downward through the material and belt;

wherein the improved method comprises the following steps:

c) cleaning the material by d) shaking the fibrous material by e) flexing the belt.

2. The process as defined in claim 1 wherein the flexing of the belt is accomplished by delivering a bump to the belt from below.

3. The process as defined in claim 1 wherein the flexing of the belt is accomplished by running the belt over an intermittent support.

4. A belt dryer for drying fibrous material having a) an elongated drying chamber, having a fibrous material inlet end and a fibrous material outlet end, b) treatment air inlets in the top of the chamber, c) an air permeable belt in the chamber below the air inlets trained over a drive wheel at the outlet end and over an adjustable wheel at the inlet end, d) the belt having a top run and a bottom run, and e) spent air outlets in the chamber below the belt;

wherein the improved structure of said spent air outlets comprises in combination with the above, f) exhaust ducts below the top run of the belt extending across the chamber, g) each duct having a longitudinal air slot in the bottom of the duct, and h) each duct having a sloping top with sufficient pitch to prevent trash from accumulating thereon.

5. The belt dryer as defined in claim 4 further comprising:

i) "V" shaped supports extending across the chamber at least partially supporting the top run of the belt, j) the "V" pointing toward the outlet end, k) the "V" shaped supports spaced apart from each other so that the belt is supported intermittently.

6. The belt dryer as defined in claim 4 wherein i) said belt is a wire mesh.

7. The belt dryer as defined in claim 4 further comprising:

i) idler rollers below the top run of the belt, each roller having an axis, and each roller rotated about its axis by the top run, j) each of said idler rollers having a gusset projecting from said roller which deliver a bump to the top run of the belt when rotated by the belt, thereby shaking material on the top belt.

8. The belt dryer as defined in claim 7 further comprising:

k) said belt is a wire mesh, and l) a sprocket on each idler roller, each sprocket engaging the belt therefore rotating its idler roller.

9. The belt dryer as defined in claim 4 further comprising:

i) longitudinal edges of the top run of the belt are at least partially supported by a support flange on a side of the chamber and is confined by hold down flanges on the side of the chamber.

10. The belt dryer as defined in claim 4 further comprising:

i) a flexible flap extending across the chamber above the bottom run of the belt, j) said flexible flap i. near the adjustable wheel, ii. angled away from the adjustable wheel, and iii. contacting a top surface of the bottom run, and k) an auger conveyor extending across the chamber above the bottom run and partially above the flexible flap.

11. The belt dryer as defined in claim 4 further comprising:

i) the bottom run of the belt is supported by a bottom of the chamber, and j) a trash conveyor extends across the bottom of the conveyor at the inlet end.

12. A belt dryer for drying fibrous material having a) an elongated drying chamber, having a fibrous material inlet end and a fibrous material outlet end, b) treatment air inlets in the top of the chamber, c) an air permeable belt in the chamber below the air inlets trained over a drive wheel at the outlet end and over an adjustable wheel at the inlet end, d) the belt having a top run and a bottom run, and e) spent air outlets in the chamber below the belt;

wherein the improved structure comprises:

f) "V" shaped supports extending across the chamber at least partially supporting the top run of the belt, g) the "V" pointing toward the outlet end, h) the "V" shaped supports spaced apart from each other so that the belt is supported intermittently.

13. The belt dryer as defined in claim 12 further comprising:

i) idler rollers below the top run of the belt, each roller having an axis, and each roller rotated about its axis by the top run, j) each of said idler rollers having a gusset projecting from said roller which deliver a bump to the top run of the belt when rotated by the belt, thereby shaking material on the top belt.

14. A belt dryer as defined in claim 13 further comprising:

k) said "V" shaped supports spaced along the chamber about 20 inches on center, and l) said idler rollers placed between adjacent "V" shaped supports.

15. The belt dryer as defined in claim 13 wherein k) said belt is a wire mesh.

16. The belt dryer as defined in claim 15 further comprising:

l) a sprocket on each idler roller, each sprocket engaging the belt therefore rotating its idler roller.

17. The belt dryer as defined in claim 12 further comprising:

i) longitudinal edges of the top run of the belt at least partially supported by a support flange on a side of the chamber and is confined by hold down flanges on the side of the chamber.

18. The belt dryer as defined in claim 12 further comprising:

i) a bottom run of the belt supported by a bottom of the chamber, and j) a trash conveyor extends across the bottom of the chamber at the inlet end.

19. The belt dryer as defined in claim 12 further comprising j) a flexible flap extending across the chamber above the bottom run of the belt, k) said flexible flap i. near the adjustable wheel, ii. angled away from the adjustable wheel, and iii. contacting a top surface of the bottom run, and l) an auger conveyor extending across the chamber above the bottom run and partially above the flexible flap.

20. The belt dryer as defined in claim 12 further comprising:

j) idler rollers below the top run of the belt, each roller having an axis, and each roller rotated about its axis by the top run, k) each of said idler rollers having a cross sectional configuration with diametrical projections which bump the top run of the belt when rotated by the belt, thereby shaking material on the belt, l) said "V" shaped supports spaced along the chamber about 20 inches on center, and m) idler rollers placed between the "V" shaped supports, n) said belt is a wire mesh, o) a sprocket on each idler roller, each sprocket engaging the belt therefore rotating its idler roller, p) longitudinal edges of the top run of the belt at least partially supported by a support flange on a side of the chamber and is confined by hold down flanges on the side of the chamber, q) a bottom run of the belt supported by a bottom of the chamber, r) a trash conveyor extends across the bottom of the chamber at the inlet end, s) a flexible flap extending across the chamber above the bottom run of the belt, t) said flexible flap i. near the adjustable wheel, ii. angled away from the adjustable wheel, and iii. contacting a top surface of the bottom run, and u) an auger conveyor extending across the chamber above the bottom run and partially above the flexible flap, v) exhaust ducts below the top run of the belt extending across the chamber, w) each duct having a longitudinal air slot in the bottom of the duct, and x) each duct having a sloping top with sufficient pitch to prevent trash from accumulating thereon, and y) said duct having two inclined planes forming the sloping top with a uppermost ridge centered over the exhaust duct.

* * * * *